United States Patent [19]

Brantl

[11] 4,142,534

[45] Mar. 6, 1979

[54] REDUCTION OF TOXIC SUBSTANCES IN TOBACCO SMOKE

[76] Inventor: Victor Brantl, Frauenplatz 10, 8 Muenchen 2, Fed. Rep. of Germany

[21] Appl. No.: 686,402

[22] Filed: May 14, 1976

[30] Foreign Application Priority Data

Sep. 4, 1975 [DE] Fed. Rep. of Germany ..... 2539418
Apr. 2, 1976 [DE] Fed. Rep. of Germany ..... 2614367

[51] Int. Cl.[2] ..... A24D 1/00
[52] U.S. Cl. ..... 131/8 R
[58] Field of Search ..... 131/8 R, 8 A, 9, 10 R, 131/10 A, 10 B, 10.5, 10.7, 10.9, 20 R, 21 R

[56] References Cited

U.S. PATENT DOCUMENTS

| | | | |
|---|---|---|---|
| 3,059,649 | 10/1962 | Bernhard | 131/10 R |
| 3,349,776 | 10/1967 | Bell et al. | 131/8 R |
| 3,614,956 | 10/1971 | Thornton | 131/10.5 |
| 3,674,036 | 7/1972 | Vega | 131/7 |
| 3,773,053 | 11/1973 | Stephens, Jr. | 131/9 |
| 3,774,622 | 11/1973 | Steigerwald | 131/8 R X |
| 3,863,644 | 2/1975 | Hunt | 131/9 |
| 3,905,377 | 9/1975 | Yatrides | 131/9 |
| 4,027,679 | 6/1977 | Kaswan | 131/9 |

FOREIGN PATENT DOCUMENTS

| | | | |
|---|---|---|---|
| 1226017 | 9/1966 | Fed. Rep. of Germany | 131/10 R |
| 1432618 | 1/1969 | Fed. Rep. of Germany | 131/10 R |
| 1905273 | 8/1970 | Fed. Rep. of Germany | 131/10 R |
| 2126807 | 12/1972 | Fed. Rep. of Germany | 131/10 R |
| 2215064 | 10/1973 | Fed. Rep. of Germany | 131/10 R |
| 266669 | 2/1968 | Switzerland | 131/10 R |

*Primary Examiner*—Robert W. Michell
*Assistant Examiner*—V. Millin
*Attorney, Agent, or Firm*—Richard L. Schwaab

[57] ABSTRACT

A tobacco-filled smoking article adapted to produce a low proportion of toxic substances such as carbon monoxide in the gaseous products of combustion comprising a tobacco filling and means to confine said tobacco, wherein within the volume of tobacco, there is at least one tobaccoless region separated from the tobacco by a substantially air-impermeable partition.

27 Claims, 15 Drawing Figures

REDUCTION OF TOXIC SUBSTANCES IN TOBACCO SMOKE

BACKGROUND OF THE INVENTION

The invention relates to low toxicity tobacco filled smoking articles, and more especially to cigarettes, cigars and/or filled pipes adapted to provide a low proportion of carbon monoxide in the combustion gases.

It has been established for a long time that carbon monoxide constitutes a very poisonous gas, which more particularly damages the cardiac blood vessels, and that a very high proportion of carbon monoxide is contained in the gaseous products of combustion from tobacco. Despite knowledge of this fact, the very numerous and extremely expensive investigations into and attempts at removing toxic substances from gaseous products of combustion of tobacco so far have only succeeded in bringing about a substantial reduction in the nicotine content and the tar content. To date it has not been possible to reduce the carbon monoxide content to a substantial extent. On the contrary, it is especially those filter cigarettes having a low nicotine content, which have a particularly high content of carbon monoxide in the gaseous products of combustion. It has been found that the carbon monoxide can hardly be removed to any extent at all by filters.

However, many other methods have been tried in order to recuce the carbon monoxide content from the gaseous combustion products of tobaccos without, however, leading to success.

Thus, for example, J. H. Terrell and I. Schmeltz investigated modifications in the composition of cigarette smoke by the formation of holes in the cigarette paper and published their results in "Tobacco Science", vol. XIV, 1970, pages 82 to 85. The holes in the cigarette paper act as inlets for additional air which dilutes the cigarette smoke. On the basis of this dilution, they found that there was naturally a reduced proportion of CO per draw in their measurements as compared to the case for one draw on a cigarette which is not externally perforated. The total quantity of CO which is formed on smoking the two different forms of cigarettes was however the same. Attention is drawn, however, to the different phenomena involved; that is to say, cigarettes with perforated cigarette paper release a larger proportion of CO to the atmosphere on smouldering between draws as compared with the inhaled quantity of CO than is the case with normal cigarettes. This is due to the fact that the cigarette with perforated cigarette paper burns substantially shorter per draw than the normal cigarette owing to the bypass air and the resulting lowered degree of suction.

This makes the substantial disadvantage of this previously proposed cigarette with perforated cigarette paper clear, i.e., the smoker, owing to the lesser absolute quantity of smoke per draw, which furthermore is diluted with bypass air, does not breath the desired smoke with an intensive flavor and instead breathes in an uninteresting highly diluted smoke mixture with a neutral flavor. Tests have shown that even ten holes in the cigarette paper have the effect of causing the burning in the smouldering zone not to be noticeably increased by a draw on the cigarette and practically only bypass air is inhaled in such a case.

Furthermore, the periodical "Tobacco Science" vol. XIV, 1970, pages 79 to 81 refers to attempts to modify the composition of the gaseous products of combustion by additives to tobacco. However, practically all of the additives referred to in this periodical resulted in a substantial increase in the CO proportion in the gaseous products of combustion, see the table at the top of page 80. The few other additives, which reduced the CO content, albeit only slightly, had on the other hand the disadvantageous effect that they substantially increased the proportion of toxic substances such as $H_2S$, NO, $SO_2$ and/or HCN.

Since none of these methods reduced the CO content noticeably, or if at all, then only with an increase of other highly toxic smoke components, attempts were made to reduce the production of the CO component by the addition of catalyst precursors which, on combustion, form highly dispersed and very active solid catalysts. See for example, the German patent application No. P 25 18 839 in the name of Victor Brantl.

SUMMARY OF THE INVENTION

An object of the invention is that of providing low toxicity tobacco-filled smoking articles, in particular cigarettes, cigars and filled pipes which contain a reduced proportion of CO in the gaseous products of combustion without impairing the flavor of the inhaled smoke.

This object is achieved in accordance with the invention by providing a tobacco filled smoking article having within the volume, normally filled with tobacco, one or more spaces which do not comprise any tobacco, are separated from the tobacco by a substantially air-impermeable partition and, if the space is adjacent to a filter, or, in the case of filterless cigarettes if it extends as far as the mouthpiece, it is terminated at this side by such a partition.

In accordance with another embodiment according to the invention, within the volume normally filled with tobacco one or more substantially air impermeable solid bodies are arranged which do not burn or smoulder or at least do not burn substantially more rapidly than tobacco.

The invention firstly involves the advantage that the proportion of CO can be reduced by more than 40%. In this respect the flavor intensity of the smoke is not impaired since this cigarette burns with the same speed as a normal cigarette with the same quantity of tobacco, the same length and the same external periphery. Added to this there is the advantage that the proportion of flavorless CO is considerably reduced without the proportion of other toxic substances being increased. A particularly substantial advantage of the invention is to be found in the fact that it makes possible the production of cigarettes and cigars with a low toxicity in a particularly simple manner and without any substantial increase in the costs of production. Finally, the further advantage should be mentioned that cigarettes which have already been rolled in the finished condition can be modified to constitute cigarettes embodying the invention.

The space provided in accordance with the invention and not comprising any tobacco can be a cavity or empty space. It can however also be filled, for example, with cellulose-containing material or with rolled paper. The use of a filling of cellulose-containing material involves the advantages that this material can be made so as to burn with the same speed of burning as the tobacco and that no interferring removal of heat occurs during burning.

The partition or separating wall itself consists preferably also of combustible material as for example of cellulose-containing material.

In accordance with a particularly advantageous further embodiment of the invention, the partition is impregnated with oxidizing substances.

The body used in accordance with the second construction in accordance with the invention can be hollow, but it can also be solid. If a hollow body is employed, it can be filled with a material, as for example, cellulose-containing material. It is also possible to use rolled paper as a body. The body and, respectively, the filling of the hollow body can comprise additives promoting combustion.

In accordance with a further embodiment of the invention, in the case of the two above-mentioned embodiments, use is preferably made of a material which on combustion assumes an amorphous consistency similar to that of tobacco ash.

In accordance with another advantageous development of the invention, the space or, respectively, the body, is constructed cylindrically and arranged in the longitudinal direction of the cigarette. This construction of the invention is particularly simple and cheap to produce. The space or, respectively, the body can however have a non-linear diameter which increases toward the mouthpiece.

Further objects, advantages and features of the invention will appear from the following detailed description of the invention read in conjunction with the drawings.

DETAILED DESCRIPTION OF PREFERRED EMBODIMENTS

Figure 1:
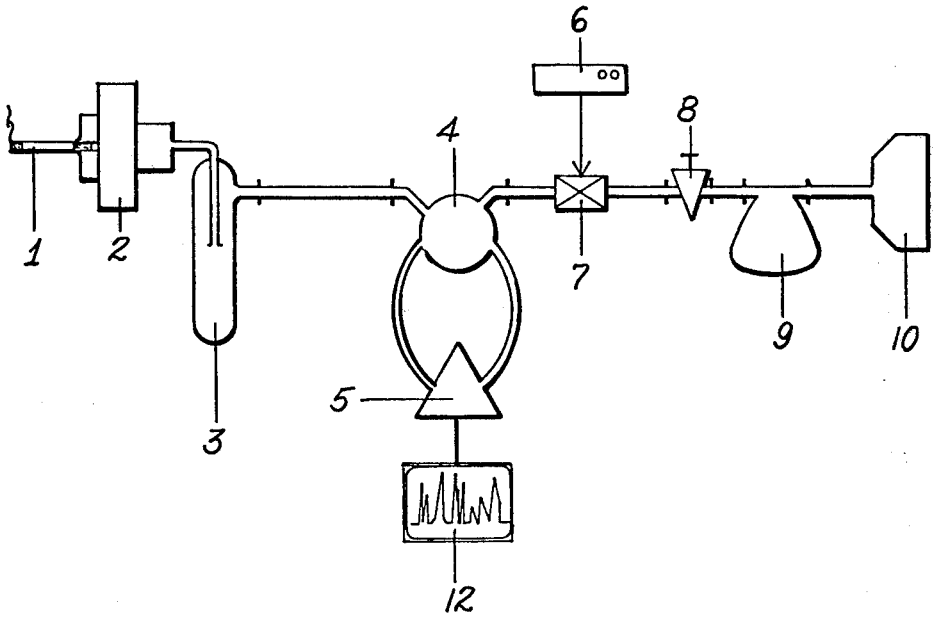
FIG. 1 shows a measuring apparatus used for the investigations which is shown diagrammatically.

The measuring apparatus in accordance with FIG. 1 comprises a Cambridge filter 2, at the inlet of which a cigarette 1 can be inserted. The Cambridge filter 2 is connected via a cooling trap 3 with a gas inlet loop 4, which comprises a switch-over valve (not shown). An outlet of this gas inlet loop 4 is connected with the input of a gas chromatography apparatus 5. The other outlet of the gas inlet loop 4 is connected via a pre-vacuum vessel 9 with a vacuum pump 10. In the duct between the gas inlet loop 4 and the pre-vacuum vessel 9 there is a solenoid valve 7, which is controlled by a timer 6, and a setting cock 8.

In operation the cigarette 1 is burnt at timed intervals by the vacuum or suction, which is produced by the vacuum pump 10. On these draws the smoke and the gaseous products of combustion of the cigarette are filtered in the Cambridge filter 2. This filter 2 retains the solid and liquid smoke components and substantially only allows the passage of the gaseous products of combustion. These gaseous products or gas are frozen out by a cooling trap 3, in which $H_2O$ and $CO_2$ are frozen out. The gas introduced from the cooling trap 3 to the gas inlet loop 4 comprises the whole CO fraction, which on every draw is sucked into the Cambridge filter 2 from the burning cigarette 1.

The vacuum pump 10 operates during the whole of the measuring operation. However, it only produces a suction at the mouthpiece of the cigarette 1 when the solenoid valve 7 is opened. This solenoid valve 7 is opened by the timer 6 at intervals of one minute, the period of opening amounting to two seconds. During these two seconds, suction is therefore applied to the cigarette. The setting cock 8, which can be used to change the cross-section of the duct between the solenoid valve 7 and the vacuum pump 10, will be so set that during this draw with a duration of two seconds a gas quantity of 35 ml is sucked or drawn through the Cambridge filter 2. This quantity of 35 ml will be sufficient to flush through the whole apparatus from the Cambridge filter 2 as far as the solenoid valve 7.

After the interval of two seconds, the solenoid valve 7 is closed by the controlling action of the timer 6. The rotary switch-over valve in the gas inlet loop 4 is now turned so that the gas chromatography apparatus 5 is connected with the gas inlet loop 4, and the carrier gas of the gas chromatography apparatus 5 flushes the gas quantity to be analyzed out of the gas inlet loop 4 and into the gas chromatography apparatus 5.

In this gas chromatography apparatus 5 the gas quantity introduced is separated by a 5-Å-molecular sieve into the different components. The different thermal conductivity values of these components are measured using a thermal conductivity detector (WLD) and these measured data are recorded by a potentiometer recorder 12.

The pre-vacuum vessel 9 between the solenoid valve 7 and the vacuum pump 10 serves in a conventional manner to prevent a breakdown of the vacuum in this vacuum line on opening the solenoid valve 7.

The measuring apparatus used operates with a very high degree of accuracy. Variations in the measured results owing to the measuring accuracy of the apparatus are substantially smaller than those variations in the measured results which are caused by the variations in consistency of the different cigarettes. Even the variations in consistency of the cigarettes of a single package, which are exposed to the same ambient factors such as air temperature, humidity and the like, are substantially greater than variations due to the measuring apparatus. The error of the overall measurement is therefore determined by the changing consistency of the individual cigarettes within a package. This error had a maximum value between 9 and 10%. In the case of some cigarette packages this variation in the measured results amongst cigarettes of a single package only reaches approximately 5%. The values for variation given were measured in the case of commercially available, unprepared cigarettes.

Figure 2A:
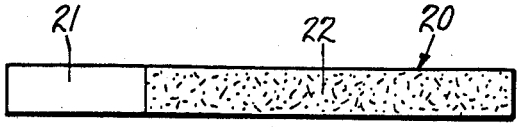
FIG. 2*a* shows a commercially available cigarette of a particular brand.

In FIG. 2*a* there is diagrammaticially represented a cigarette 20 which comprises a filter part 21 and a tobacco part 22. A number of such cigarettes, which are sold in the German Federal Republic under the brand name of "Auslese", were measured in the measuring apparatus of FIG. 1.

Figure 2B:
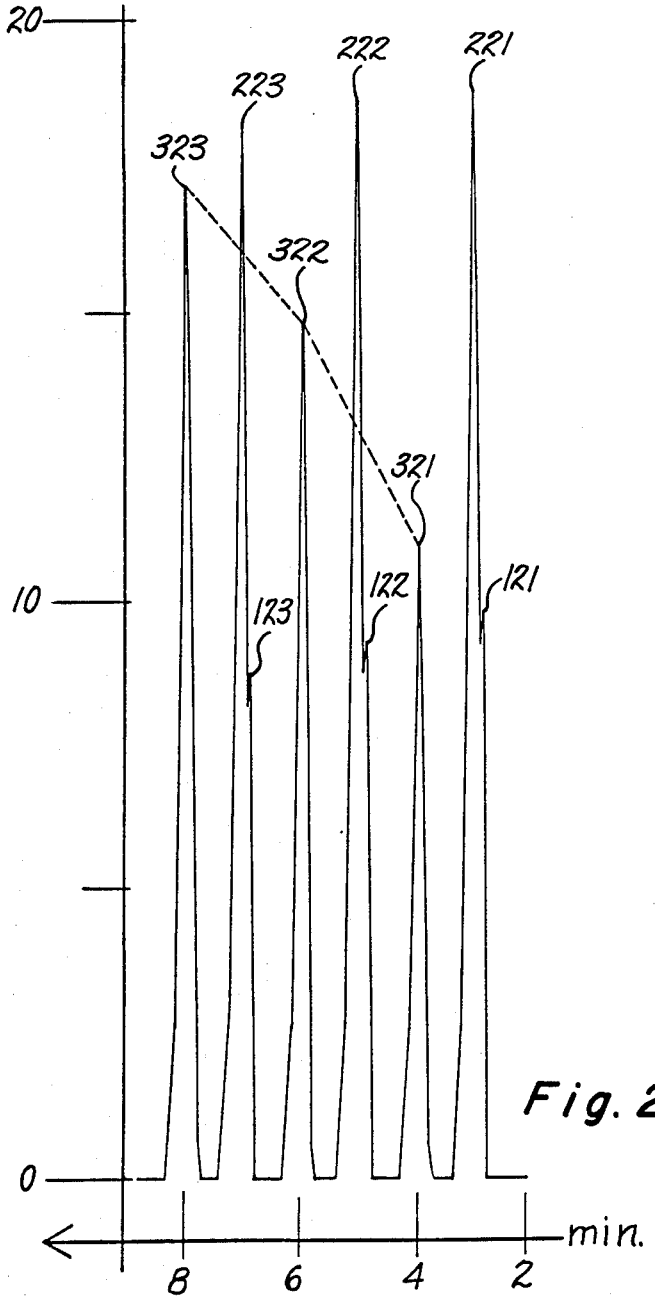
FIG. 2*b* shows a gas chromatogram of the $N_2$, $O_2$ and CO fractions in the gaseous products of combustion of the cigarette of FIG. 2*a*.

In FIG. 2*b* the data recorded by the recorder 12 are represented as applicable for such a cigarette. These values of FIG. 2*b* are the typical values of such a cigarette, that is to say, great care was taken to see that the values of a cigarette were not selected, which would be non-typical owing to unusual departures in consistency.

The horizontal axis of FIG. 2*b* is a time scale, which is divided up into minutes. In this respect it is to be pointed out that the time scale runs from the right to the left as is indicated by an arrow. The results of measurement of the later draws are therefore plotted respectively to the left of the results of measurement of the preceding draws.

On the vertical axis of FIG. 2*b* quantities of the gas values are plotted with a linear pitch. Nine curves are plotted over the time scale. Of these nine curves, three curves relate to a determination of the gas fractions in the gas volume of one draw on the cigarette. Within these three curves, respectively, the first curve corresponds to the content of $O_2$, the second curve corresponds to the $N_2$ content and the third curve corresponds to the CO content. These three blocks with three curves are the measured values which were obtained on the fourth, sixth and eighth draws respectively.

The different plotted curves are denoted by reference numerals at their peaks. The reference numeral 121 denotes the plotted curve for the $O_2$ content in the case of the fourth draw.The reference numeral 221 denotes the plotted curve for $N_2$ in the case of the fourth draw and the reference numeral 321 denotes the plotted curve for CO in the case of the fourth draw.

The reference numeral 122 denotes the plotted curve of $O_2$ in the case of the sixth draw, that is to say, the second plotted curve of $O_2$ in the case of the same cigarette. Accordingly, the reference numeral 222 denotes the second plotted curve of $N_2$, that is to say, the plotted curve for $N_2$ of the sixth cigarette, and reference numeral 322 denotes the second plotted curve for CO, that is to say, the plot in the case of the sixth draw. In a similar manner the reference numerals 123, 223 and 323 denote, respectively, the third plotted curve of the three different gases, i.e., those plotted curves which are produced on the eighth draw. The center number 2, always remaining the same, denotes the cigarette used, namely, the cigarette in accordance with FIG. 2*a*.

The areas of the respective plotted curves are proportional to the quantity of gas measured. The area of the plotted curve 121 is proportional to the $O_2$ quantity in the case of the fourth draw. The area under the curve 221 is proportional to the quantity of measured $N_2$ in the case of the fourth draw and the area under the curve 321 is proportional to the quantity of CO measured in the case of the fourth draw. The sum of areas underneath the curves 121, 221 and 321 accordingly represents the sum of the quantities of gas as regards $O_2$, $N_2$ and CO. These three quantities of gas together form over 98% of the gas quantity analyzed. For the following evaluations, therefore this gas quantity made up of the three components, which was determined on the basis of the areas of the corresponding curves, was counted as being 100%. The area of the curve 121, divided by the sum of the areas of the curves 121, 221 and 321 accordingly indicates the proportion of $O_2$ as a percentage of the whole gas quantity measured in the gas chromatography apparatus. For a precise analysis of the absolute values, however, the different thermal conductivities in relation to the carrier gas must be taken into account.

The area of the curve 221 divided by the sum of the areas of the curves 121, 221 and 321 accordingly indicates the quantity of the measured $N_2$ as a percentage of the overall gas quantity measured. In a similar manner, the area underneath the curve 321 divided by the sum of the areas of the curves 121, 221 and 321 indicates the proportion of CO as a percentage of the overall gas quantity measured.

The value of the absolute quantity of the CO present in the case of one draw, for example, the quantity which is in accordance with the curve 321, does not have to be determined for understanding the present invention, as will be further indicated in the description below. The interesting feature of FIG. 2*b* is instead the possiblity of reading how the content of each of these gas components changes from the fourth to the sixth and from the sixth to the eighth draw.

For determining this change it is initially necessary to point out that the quantity of gas is proportional to the area of the corresponding curve. Since in this FIG. 3*b* the bases of the CO curves of the fourth, sixth and eighth draw, namely, the bases of the curves 321, 322 and 323, are approximately of the same breadth and furthermore the flanks of the curves run generally straight and since, in addition, the vertical axis is divided linearly, the quantity values of one component bear a relationship to each other which is approximately the same relationship as that obtaining between the peak values. Therefore, the change in the peak values can be considered equivalent to the changes in the gas quantities in a first approximation.

This knowledge makes it possible to see on the basis of FIG. 2*b*, by glancing at the peak values 321, 322 and 323, which correspond to the CO curves, that the content of CO per draw increases approximately linearly from the fourth to the eighth draw. The increase in the CO content was determined in the case of all commercially available cigarettes investigated here.

FIG. 2*b* shows furthermore the $N_2$ curves 221, 222 and 223, which correspond to the $N_2$ values in the case of the fourth, sixth and eighth draws, respectively.

Furthermore, in FIG. 2*b*, also the plotted curves of the $O_2$ are represented in the case of the fourth, sixth and, eighth draws, respectively; these curves are denoted by the reference numerals 121, 122 and 123.

The $N_2$ content and the $O_2$ content in the case of the different draws are represented in FIG. 2*b* also on a linear scale; however, this linear scale is not the smae as that used for the CO content. The scale for the representation of $N_2$ and $O_2$ is, however, the same.

The CO value was measured in comparison with the $N_2$ or the $O_2$ value with a 16-fold amplification. In order to determine the ratio of the CO content with respect, for example, to the $N_2$ content in the case of the eighth draw, it would be necessary to divide the area of the curve 123 by the area of the curve 223 multiplied by 16.

The identical type of representation, as selected for FIG. 2*b*, was also selected for the FIGS. 3*b*, 4*b*, 6*b*, 7*b*, 8*b*. A detailed description of the individual figures individually is therefore not necessary.

After describing the manner of representation employed in the FIGS. 2*b*, 3*b*, 4*b*, 6*b*, 7*b*, and 8*b*, the essence of the present invention will be described by making a comparison with each other of individual figures of this series.

Figure 3A:
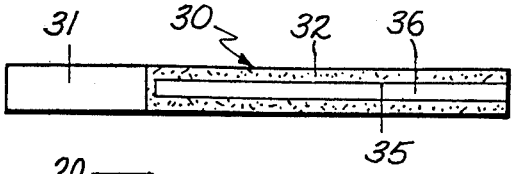
FIG. 3*a* shows a cigarette of the same sort as FIG. 2*a*, but modified with a hollow internal space and with a partition allowing the passage of air.
Figure 4A:
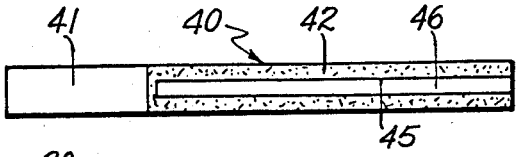
FIG. 4*a* shows a cigarette, modified in accordance with the invention, but otherwise of the same type as that shown in FIG. 2*a*, with an air-tight partition between the tobacco and the hollow space or cavity.

In FIGS. 2*a*, 3*a* and 4*a* three cigarettes of the "Auslese" brand are represented. FIG. 2*a* relates to the non-modified cigarette 20 as purchased, which has a filter part 21 an a tobacco part 22. FIG. 3*a* shows a similar cigarette 30 with a filter part 31 and a tobacco part 32. This tobacco part 32 is however arranged in an annular chamber or in an annular zone. Within the volume normally filled with tobacco there is a hollow space or cavity 35. The cavity 35 is separated from the tobacco by a separating wall or partition which is made of cigarette paper and is therefore permeable. This intermediate wall or partition 36 has approximately the same shape as a hollow cylinder, which is closed at the mouthpiece end. This hollow cylinder has a diameter of approximately 3mm.

In FIG. 4a a cigarette 40 is represented, which also has a filter part 41 and a tobacco part 42. As is the case with the cigarette 30, in the case of this cigarette 40 also the volume, which is normally filled with tobacco, has a cylindrical space 45 arranged in it. This space 45 is separated by a partition 46 or separating wall from the tobacco. This partition also has the form of a hollow cylinder, which at its end adjacent to the filter part 41 is terminated or closed. In contrast to the partition 36 however this partition 46 is air-tight.

The cigarettes 30 and 40 were both made from a cigarette of the commercially available brand "Auslese". This means that three cigarettes from one and the same package were taken. One cigarette, the cigarette 20, was not modified. In the second cigarette 30, the space 35 was formed and the partition 36 was put in place, no tobacco being removed from the cigarette. The generally annular tobacco part 32 accordingly comprises the same quantity of tobacco as the cigarette 20. Since the outer periphery of the cigarette 30 is the same as that of the cigarette 20, the tobacco in the annular tobacco part 32 is accordingly more densely packed than the tobacco part 22 of the cigarette 20.

Furthermore, the cigarette 40 was initially the same as the cigarette 20 and came from the same package. In the case of this cigarette 40 as well, the inner channel 45 was formed and in this case the partition 46 consisting of air-tight paper was put into position, again no tobacco being removed. Furthermore, the annular chamber 42 comprises exactly the same quantity of tobacco as the tobacco part 22 of the cigarette 20.

Both the inner space of the cigarette 30 and also that of the cigarette 40 have a diameter of approximately 3mm. The packing density of the tobacco is in the case of the cigarettes 30 and 40 accordingly approximately 14% higher than is the case with the cigarette 20.

Figure 3B:
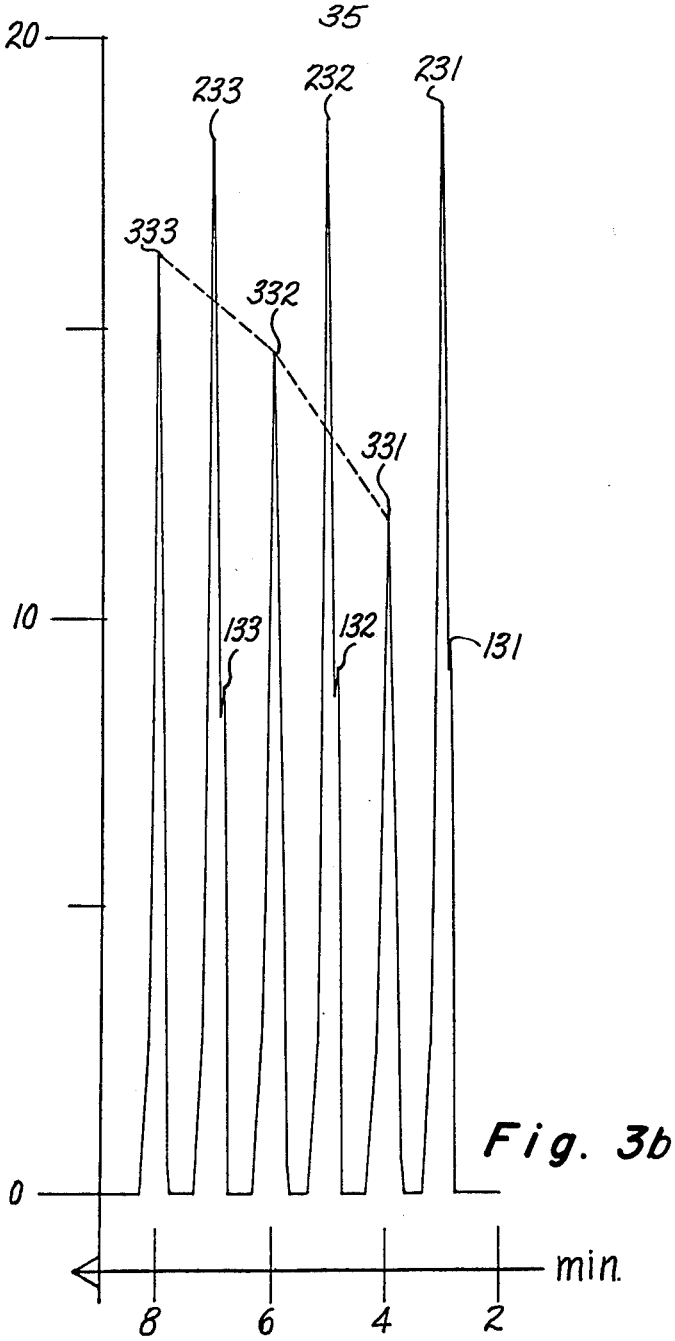
FIG. 3*b* shows a gas chromatogram of the $N_2$, $O_2$ and CO fractions of the gaseous products of combustion of the cigarette in accordance with FIG. 3*a*.
Figure 4B:
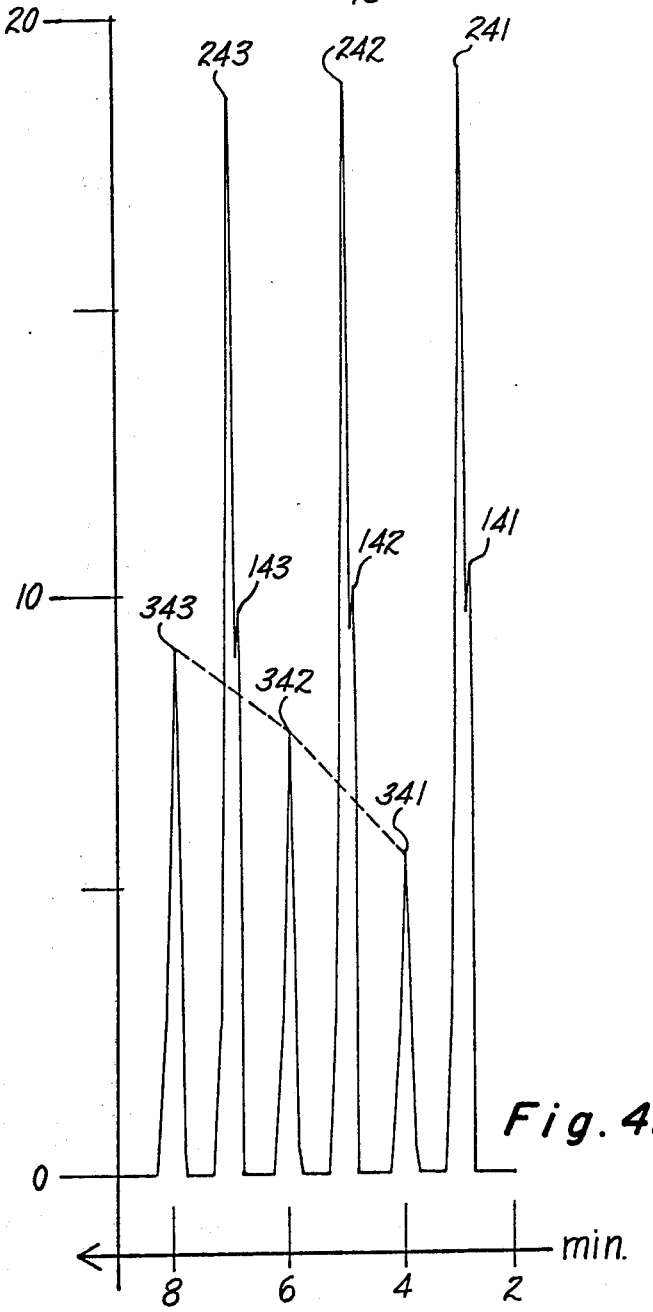
FIG. 4*b* shows a gas chromatogram of the $N_2$, $O_2$ and CO fractions of the gaseous products of combustion of the cigarette in accordance with FIG. 4*a*.

These three cigarettes 20, 30 and 40 were smoked one after the other in the measuring apparatus of FIG. 1. The values measured in this case are represented in FIGS. 2*b*, 3*b* and 4*b*. The CO values measured in this respect are now compared with each other.

By comparing the peak values of the CO curves, which are connected broken lines, it will be seen that the cigarette 20 and the cigarette 30 produce approximately the same CO quantities. This applies both for the comparable individual draws and also for the increase in the CO quantity from the fourth to the sixth and from the sixth to the eighth draws.

The correspondingly broken connecting lines between the peaks of the curves 341, 342 and 343 on the other hand lie, as can be clearly seen, approximately 35% underneath the corresponding curves of FIGS. 2*b* and 3*b*. The cigarette 40, which has a generally cylindrical space, which is separated from the tobacco space 42 by a partition 46 consisting of air-tight paper, produces therefore approximately 35% less toxic CO than the two other cigarettes.

In the case of this cigarette 40 as well, the CO fraction produced increases from the fourth to the sixth and from the sixth to the eighth draws.

Figure 5:
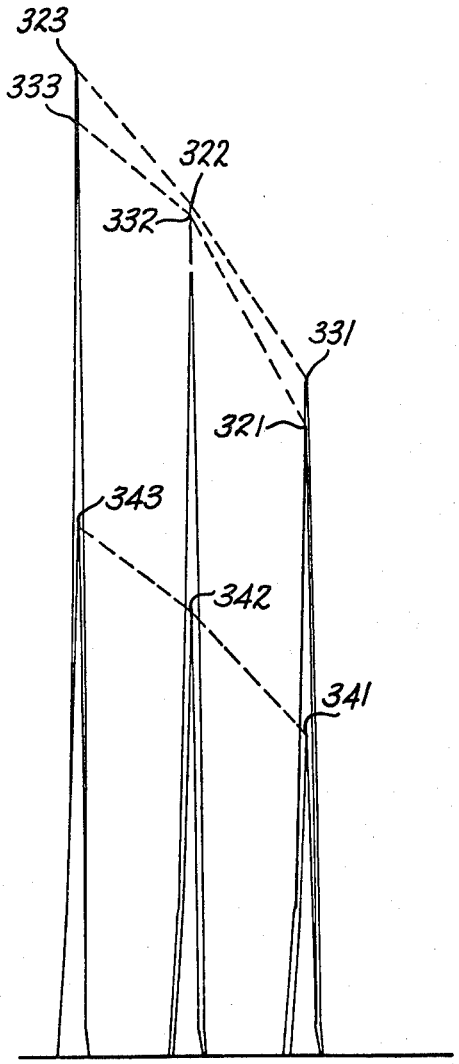
FIG. 5 shows a combined gas chromatogram of the CO values of FIGS. 2*b*, 3*b* and 4*b*.
Figure 6B:
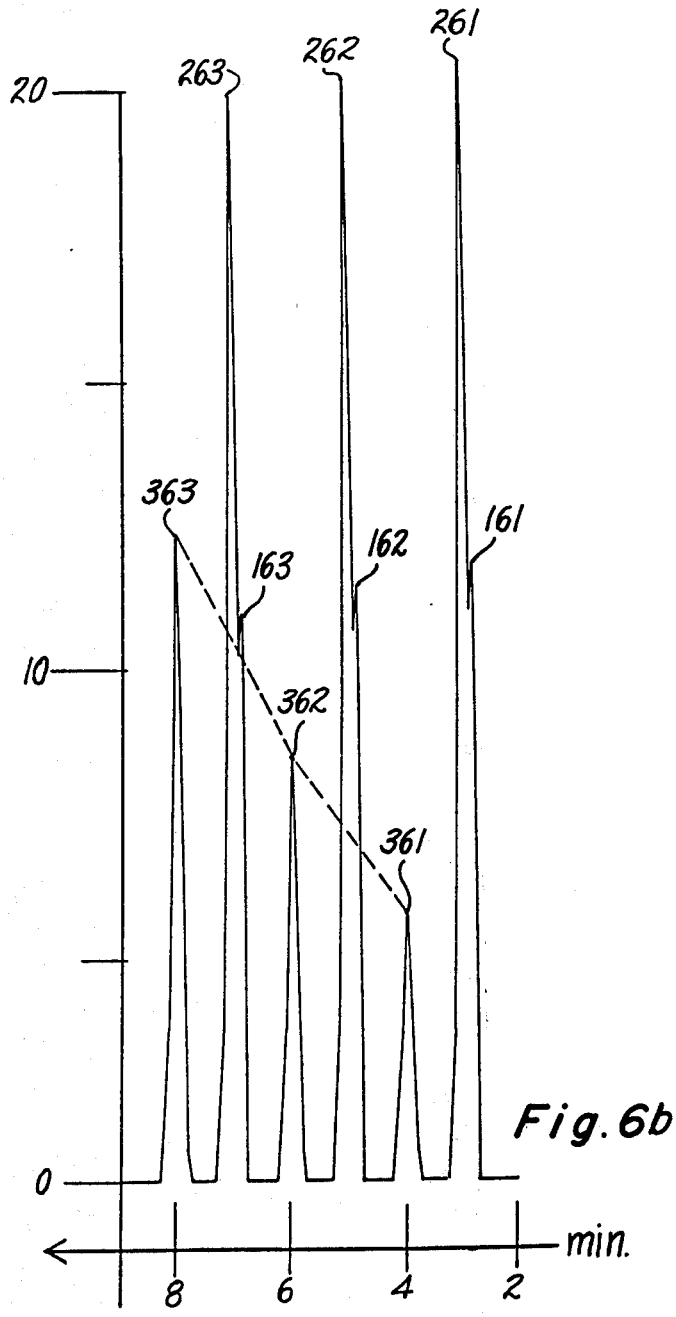
FIG. 6*b* shows a gas chromatogram of the $N_2$, $O_2$ and CO fractions of the gaseous products of combustion of the cigarette in accordance with FIG. 6*a*.

In FIG. 5, the CO peak values of the cigarettes 20, 30 and 40 are represented. In this respect, the peak values of the three different cigarettes are plotted for the respective identical draw. It can be seen from this FIG. 5 that the cigarette 30 for each of the draws 4, 6 and 8 produces approximately the same quantities of CO as the cigarette 20. The cigarette 40, however, which has an internal space or cavity with an air-tight partition 46 produced 45 to 50% less CO than the cigarettes 20 and 30, this applying for each draw measured.

For the sake of completeness, however, it is to be mentioned that the cigarettes 30 and 40 burnt between the draws and also during the draws with the same speed as applied for cigarette 20. The burning times of these cigarettes 30 and 40 are therefore approximately equal to the burning time of the cigarette 20. The burning speeds of the cigarettes 30 and 40 also 70 and 80 varied by $\mp 10\%$, at the most with respect to the cigarettes 20 and 60, respectively, of the corresponding identical cigarette package.

All measured cigarettes were smoked down to an end length of approximately 24 mm, including the filter. Ten draws or puffs were taken from each cigarette.

Figure 6A:
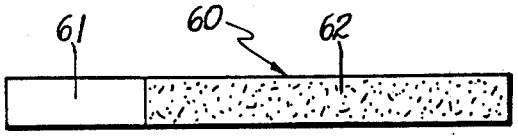
FIG. 6*a* shows a commercially available cigarette of another brand.
Figure 7A:
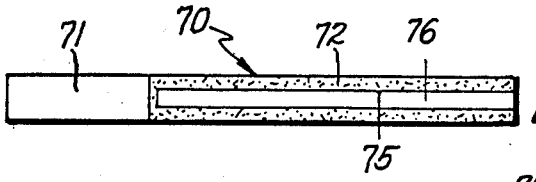
FIG. 7*a* shows a cigarette of the same brand as FIG. 6*a*, though modified with a hollow inner space and with a partition allowing the passage of air.
Figure 7B:
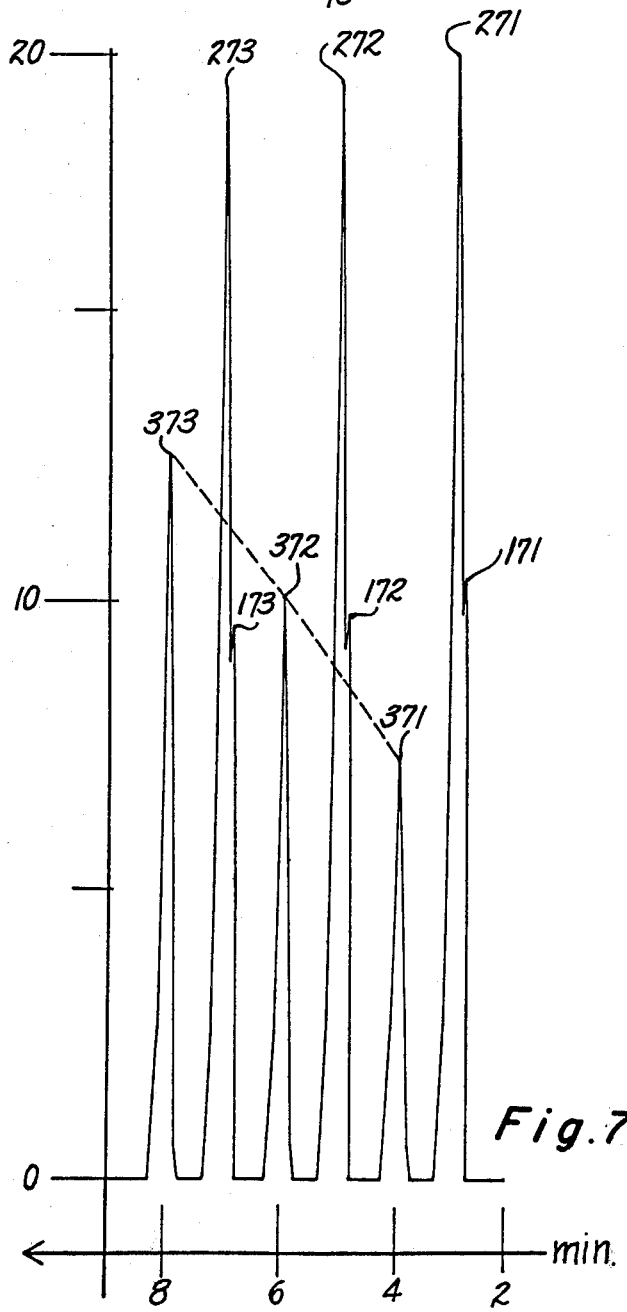
FIG. 7*b* shows a gas chromatogram of the $N_2$, $O_2$ and CO fractions of the gaseous products of combustion of the cigarette in accordance with FIG. 7*a*.
Figure 8A:
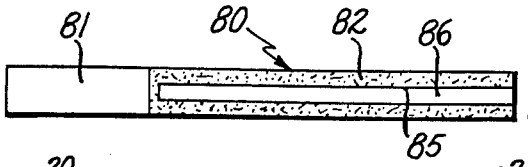
FIG. 8*a* shows a cigarette, modified in accordance with the invention, of the same brand as shown in FIG. 6*a* with an air-tight partition between the tobacco and the hollow space.
Figure 8B:
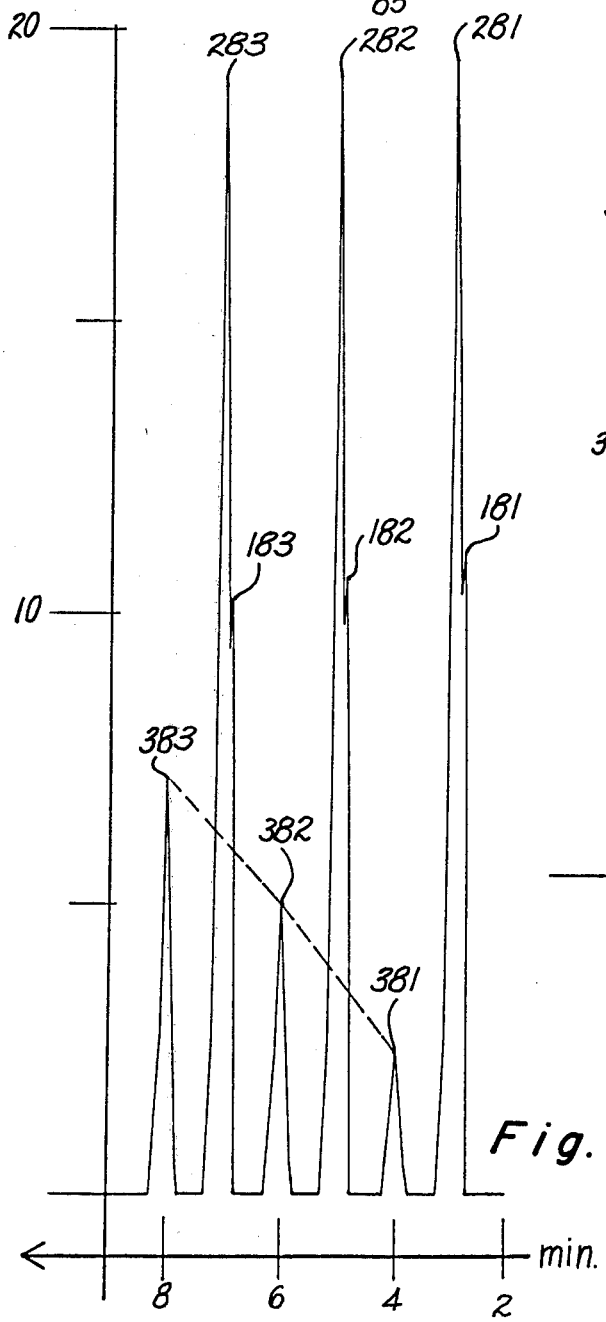
FIG. 8*b* shows a gas chromatogram of the $N_2$, $O_2$ and CO fractions of the gaseous products of combustion of the cigarette in accordance with FIG. 8*a*.

In FIGS. 6*a*, 7*a* and 8*a*, cigarettes are represented which are sold in the German Federal Republic under the trade name "R 6". These three cigarettes 60, 70 and 80 therefore again originated from one and the same cigarette package. The cigarette 60 was not modified.

The cigarette 70 was originally identical to the cigarette 60. In the volume of the cigarette 70 normally filled with tobacco a cavity or space 75 was formed, which is separated from the surrounding tobacco by a partition 76 of paper permeable to air. This partition 76 has the form of a hollow cylinder, which is closed at its end adjacent to the filter part 71. The quantity of tobacco comprised in the annular space 72 of the cigarette 70 is equal to the quantity of tobacco in the tobacco part 62 of the cigarette 60.

The cigarette 80 of FIG. 8a differs from the cigarette 70 only in that the partition 86 is made of air-impermeable paper.

Both the space 75 of the cigarette 70 and also the space 85 of the cigarette 80 have a diameter of approximately 3mm. The space extends in the case of the two cigarettes 70 and 80 from the front to approximately the front side of the filter.

The three cigarettes 60, 70 and 80 were smoked one after the other in the apparatus of FIG. 1, and the quantities of gas produced were measured. The results of measurement are represented in FIGS. *6b, 7b* and *8b*, respectively.

Even a comparison of FIGS. *6b* and *7b* will show that the cigarette 70, which has a space 75 with an air-permeable partition 76, in the case of each of the draws four, six and eight plotted, produces a larger quantity of CO than the cigarette 60. It must, however, be pointed out that the speed of burning of the cigarette 70 was approximately 10% higher than the speed of burning of the cigarette 60. The cigarette 70 was therefore shorter on the fourth, sixth and eighth draw, respectively, than the cigarette 60 in the case of the corresponding draws. Since all cigarettes measured produced a larger CO quantity with a decrease in the cigarette per draw this means that the measured CO quantities of FIG. *7b*, if they are to be compared with the measured CO quantities of FIG. 60 for the respective same cigarette length, must be suitably corrected to make a reduction. The cigarette 70 produces, in the case of the same cigarette length, a CO quantity which lies above the CO quantity produced by the cigarette 60 at the same length.

However, what is decisive for the present invention is the fact that the cigarette 80, both in the case of the fourth and also in the case of the sixth and eighth draws, produces only a quantity of CO which is 37% below the CO quantities which are produced by the cigarette 60 in the case of the respective corresponding draws. This cigarette 80 burnt for precisely the same length of time as the cigarette 60. These values compared with each other, in the case of the fourth, sixth and eighth draws, thus correspond to the same length of the cigarette 80 and to the cigarette 60. These values are therefore directly comparable with each other without any correction being necessary.

Figure 9:
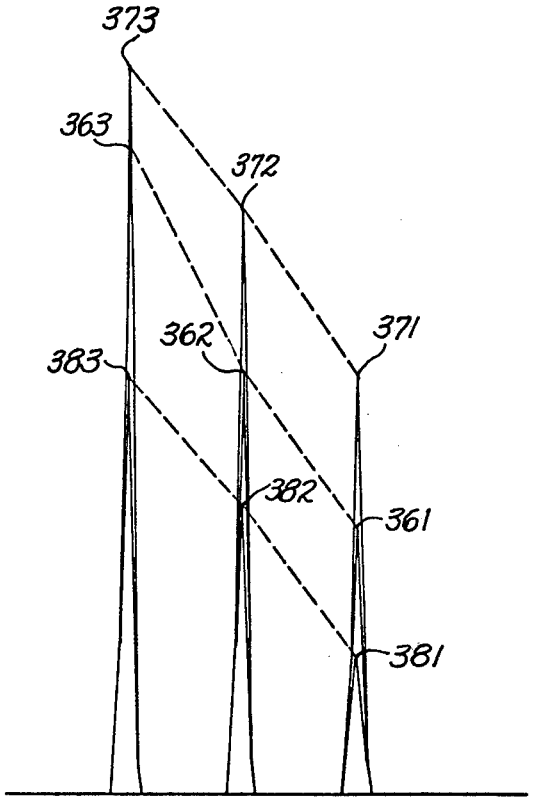
FIG. 9 shows a combined gas chromatogram of the CO values in respect to FIGS. 6*b*, 7*b* and 8*b*.

FIG. 9 shows a plot similar to that of FIG. 5, but in this case for the cigarettes 60, 70 and 80. In this FIG. 9, for the fourth, sixth and eighth draws on the cigarettes 60, 70 and 80, respectively, the measured peak values of CO curves are arranged one above the other. The values of CO curves are arranged one above the other. The center curve 60 is the connecting line of the peaks of the CO curves of the cigarette 60 for the fourth, sixth and eighth draws.

As will be gathered from FIG. 9, the cigarette 80, which has an air-tight partition between the internal space and the tobacco, produces approximately 37% less CO than the cigarette 60 for each measured draw. The cigarette 70 produces for each measured draw a substantially larger CO quantity, as has been mentioned above, though the values of the curve 70 must be corrected to make a reduction so that a curve would be obtained lying between the curve 60 represented and the curve 70 represented.

It is, furthermore, pointed out that the wording "air-permeable partition" and "air-impermeable partition" are in no way to be taken in an absolute sense. The wording "air-permeable" is used to denote the partitions 35 and 75 of the cigarettes 30 and 70 respectively. These partitions consist of a single layer of commercially available cigarette paper.

The partitions 45 and 85 of the cigarettes 40 and 80 respectively which are termed "air-impermeable" consist of a layer of commercially available typing paper, which has a weight per square meter of 80 g.

The wording "substantially air-impermeable" as used in claim 1 is intended to mean that cigarettes with partitions, which are admittedly somewhat more air-permeable than the typing paper described, but more air-impermeable than cigarette paper, come within the scope of the invention, since in the case of these papers, the effect of the invention is obtained, albeit to a lesser extent.

Based upon the fact that a reduction of CO results with the use of a separating wall which is more air-permeable than typing paper having a weight per square meter of 80 grams but less air-permeable than the cigarette paper employed, although the reduction is to a somewhat lesser extent, it is apparent that an absolute limiting value for the porosity of the separating wall to be employed is not capable of specific definition or calculation. It must also be understood that such a limiting value for the porosity is a function of the required and/or desired minimal reduction of the carbon monoxide content in the combustion products or smoke.

Before describing the investigations for determination of these various suitable ranges of porosity, it is desirable to first discuss briefly the preparation of the cigarettes modified in accordance with FIGS. *3a, 4a, 7a*, and *8a* of the drawings.

To prepare such a cigarette, the first step involves insertion into a commercially available cigarette of a glass rod, which tapers to a point on its forward end in the form of a cone having a length of approximately 6 mm. As this glass rod is inserted into the cigarette, the tobacco from the central region of the cigarette is forced into the annular space existing around the glass rod. The rod is then removed from the cigarette, and at this point the paper which is to be used to form the separating barrier is wrapped around the rod. The pieces of paper employed are measured so that as they are wrapped around the outer surface of the glass rod their longitudinal edges overlap to an extent of about 2 mm. in parallel fashion to the longitudinal axis of the rod. The forward portion of the piece of paper is twisted together over the conical point of the glass rod, so that the thus-formed paper shell which is generally cylindrical and which at its forward end converges into a point is closed at its forward end. The glass rod is then inserted into the central region of the cigarette together with this paper shell wrapped thereabout it, and the rod is then removed from the cigarette without the paper shell. The separation of the paper shell from the glass rod does not cause any problems, since the paper generally adheres more strongly to the tobacco surrounding it than it does to the glass rod.

In connection with this preparation method, care must be taken when cigarette paper is employed merely so that it is not torn during introduction into the cigarette. In order to avoid such tearing or rupture which occurs as a result of introduction of the glass rod, it is necessary to insert the glass rod without any interruption in the movement and with a movement which is as uniform as possible.

There are several explanations for the fact that the use of a cigarette paper which has a porosity of 94 ml./min. × $cm^2$ × 100 mm. $H_2O$ in connection with the first type of cigarette produced only a very small decrease of the CO content (see FIG. 5) and that it produced even an increase of the CO content in the case of the second cigarette (see FIG. 9). One reason for this is the porosity of the paper. As a result of this porosity, the property of the separating wall according to the invention is absent, namely that it must be substantially air-impermeable. There exists, however, still additional reasons for this undesired air-permeability of the separating wall. Observations of the burning cigarette with the naked eye permit recognition of the fact that the separating wall formed from typing paper having a density of 80 g/$m^2$ generally holds its form during burning of the cigarette, both between draws as well as during the draws. This can be seen in connection with the inner and outer boundaries of the annular burning or glowing region which remained unchanged. On the other hand, the separating walls formed from the above-mentioned cigarette paper in the manner described are not form-stable during the draws on a cigarette, a fact which can be readily observed by the naked eye by means of the irregular inner contour of the annular burning zone. The separating walls of cigarette paper either collapse and/or they wrinkle under the effect of heat toward the direction of the inner space, so that the longitudinal region of the paper which originally overlapped no longer does so. In both cases, external air can pass into the inner region of the cigarette and into the burning zone.

In connection with the investigations for the purpose of determining the porosity limits which correspond respectively to the desired CO reducing effect, it is necessary to produce and introduce into the cigarette separating walls which remain form-stable even under the effect of heat during burning of the cigarette. Only by preventing alterations in the shape of the separating walls and the results thereof, can the influence of the porosity upon the decrease of carbon monoxide content be investigated.

In order to produce such separating walls which are form-stable even under the influence of heat, a somewhat different technique is employed. For the task of compressing the tobacco out of the central region of the cigarette and into the annular space thereof, there is employed a glass rod of approximately 3 mm. in diameter which tapers at its forward end into a cone of approximately 6 mm. in length. The paper employed to form the separating walls is first accurately cut into predetermined sizes such that by wrapping the pieces of paper around the glass rod the edges thereof overlap with one another to form a folding border of 2 mm. in width, again along the longitudinal axis of the rod. In addition, the pieces of paper are characterized by longitudinal excess length so that upon twisting of the paper around the conical point a tighter closure can be produced at the point. However, before wrapping the paper around the glass rod, the paper is coated along the 2 mm. thick longitudinal edge regions thereof with a paste or glue, for example, one commercially available under the designation UHU-Stick. This coated longitudinal edge region defines the inner side of the upper paper strip of the binding fold in the final separating wall structure. The other longitudinal edge is then bent or folded towards the inside, toward the binding layer, so that it rests tightly against the glass rod as it is wrapped thereabout. As the paper is wrapped upon the glass rod beginning from this uncoated longitudinal edge and proceeding to the coated longitudinal edge, the folding border is automatically bonded together. Subsequently, the forward end of the paper is twisted about the conical end of the glass rod. This glass rod then together with its paper shell, which will subsequently form the separating wall, is introduced into the cigarette. Once again, in connection therewith care must be taken to see that the insertion is carried out continuously and as uniformly as possible. It was found that approximately 40% of commercial cigarettes modified in this manner were unusable because of tearing of the paper. The subsequent withdrawal of the glass rod was again no problem, since the paper adhered well to the tobacco.

The following investigations were again carried out with the two brands of cigarettes mentioned hereinabove, which are available in the German Federal Republic under the marks "Auslese" and "R 6". These cigarettes each have a total length of 84 mm. The filter portion has a length of 20 mm. so that the length of the tobacco portion amounts to 64 mm. As already stated, the brown paper which surrounds the filter has a length of 24 mm., so that it therefore encircles the end of the tobacco portion closest to the mouth piece for a length of 4 mm.

In accordance with the following discussion, the term "end length" means respectively the total length thereof including the filter. Thus, with an end length of 27 mm. the length of the tobacco portion remaining amounts to 7 mm.

The end lengths are determined in connection with all cigarettes by measuring the length of the unburned paper beginning with the mouth-piece end of the filter. If a cigarette is non-uniformly burned so that it has burned farther on one side than on the other, the largest and the smallest length of unburned paper are measured longitudinally along the outer surface of the cigarette. There is then used as the end length the average value of these two extreme lengths.

The following series of experiments was carried out with cigarettes of the "Auslese" brand.

First, the CO content of a normal cigarette was measured. This measured value is referred to hereinafter as the standard value. This standard value was found to be $CO_{Standard=91}$. This value of 91 is a dimensionless value within a linear scale. In order to determine it, each cigarette was drawn upon eight times. The amount of CO was measured in connection with the fourth, sixth and eighth draw, these values were added and then divided by three. After the eighth draw, the cigarettes had an end length of approximately 27 mm.

Subsequently, there was measured the CO content of cigarettes which contained a separating wall made of cigarette paper having various different porosities, in each case the separating wall being glued along the longitudinally extending folding border. Cigarettes having separating walls with porosities of 14, 42, 94, 142 and 233 were investigated, the porosity in each case being expressed in the units ml./min. × $cm^2$ × 100 mm. $H_2O$. The results of these investigations are set forth in Table 1.

TABLE 1

| Cigarettes of the brand "Auslese" Standard Value: Co=91 | | | | | |
|---|---|---|---|---|---|
| Porosity of the separating wall in ml/min × cm² × 100 mm $H_2O$ | 14 | 42 | 94 | 142 | 233 |
| CO-content in dimensionless Units | 72 | 79 | 88 | 91 | 87 |
| CO-content in percent of the Standard Value | 79 | 87 | 97 | 100 | 95.5 |

From this table one can see at a glance that a cigarette modified according to the invention, having a separating wall made of cigarette paper of a porosity of 14, contains only 79% of the standard value of carbon monoxide, and therefore gives rise to a reduction of 21% of the CO content. The cigarette modified according to the invention with a separating wall having a porosity of 42 contains already 87% of the CO content of the standard value. In this case, there results a decrease of only 13% of the carbon monoxide content.

Cigarettes having a separating wall with a porosity of 94, 142 or 233 have a CO content which lies so slightly under the standard value that it can hardly be said that a reduction of the CO content takes place.

From this table it can be seen that reduction of the carbon monoxide content decreases with increasing porosity of the cigarette papers utilized to form the separating wall. If one therefore considers a certain amount of reduction as substantial if it amounts to at least about 10%, then the following result is obtained: For cigarettes of the brand "Auslese" the limiting value of the porosity of the paper utilized to form the separating wall amounts to 42 ml/min × cm² × 100 mm. $H_2O$. The determination of this limiting value is valid, as shall be explained hereinafter, merely for inner separating walls having an enclosed diameter of 3 mm. On the other hand, if one requires a minimum reduction of the CO content of approximately 20%, then the limiting value of the porosity (again in the case of using a separating wall which encompasses a hollow space of 3 mm. diameter) amounts to 14 ml./min. × cm² × 100 mm. $H_2O$.

It should also be pointed out that the measurement results in Table 1 refer to cigarettes which have been drawn upon eight times apiece. The investigated cigarettes had approximately comparable end lengths at the conclusion of the test.

Interesting also were the results of a second investigation utilizing the cigarettes of the brand "Auslese". In particular, the CO values of such cigarettes were measured in connection with which a hollow channel was formed in the center of the cigarette extending all the way to the end surface on the tobacco side of the filter, again by employing the glass rod exactly in the same manner as with the other cigarettes in order to radially displace the tobacco from the center region of the cigarette. After removal of the glass rod, the cigarette was investigated in the same manner with respect to its CO content. The same testing procedure was used, i.e., the cigarette was drawn upon eight times, the fourth, sixth and eighth draws were recorded and the measured CO amounts were then added and divided by three. This cigarette having an unlined, hollow channel therein had a value of $CO_{channel}=120$. Therefore, the CO value of a cigarette prepared in this manner, having a central, tobacco-free space, which is not separated from the tobacco by means of a separating wall, is 32.5 percent higher than the standard value of the normal cigarette.

In addition, the influence of porosity of the separating wall was also investigated in connection with cigarettes of the brand "R 6", by means of the same procedures. Initially, the standard value was determined, or in other words, the CO content of an unmodified cigarette of this brand. Once again, the CO values of the fourth, sixth and eighth draws were measured, which values were then added together and divided by three. In this manner, there was obtained a standard value of $CO_{Standard}=73.5$.

When these cigarettes were modified by insertion of the separating wall of typing paper having a weight per unit surface area of 80 g/m², a CO content of CO=50 was obtained. This content of carbon monoxide amounts therefore to 68% of the standard value. Thus, the reduction amounts to 32%. In addition, separating walls made of cigarette paper having various different porosities were investigated, once again where the separating wall structure was glued along its longitudinal folding border. These separating walls likewise surrounded a tobacco-free space having a diameter of 3 mm. The results are set forth in Table 2.

TABLE 2

| Cigarettes of the Brand "R 6". Standard Value: CO = 73.5 (End length 39 mm.) | | | | | | |
|---|---|---|---|---|---|---|
| Porosity of the separating wall paper in ml/min × cm² × 100 mm $H_2O$ | 14 | 25 | 42 | 94 | 142 | 233 |
| CO content in dimensionless units | 43 | 64 | 67 | 80 | 91 | 100 |
| CO content in percent of the Standard Value | 58.5 | 87 | 91 | 114 | 124 | 150 |
| End length | 39.5 | 34.5 | 37 | 35 | 34 | 29 |

A cigarette of this brand which has been modified by introduction of the glass rod and displacing the tobacco out of the central region in order to form an inner channel extending all the way back to the filter delivered a value of $CO_{channel} = 89$.

In connection with this cigarette of the brand "R 6"5 there was obtained with separating walls which surround a tobacco-free space having a diameter of 3 mm a limiting porosity value of approximately 42 ml/min × cm² × 100 mm $H_2O$. When using a separating wall having this porosity value of 42, the CO reduction with respect to the standard value amounts to 9% according to the table. With this reduction value it must be taken into consideration that the end length of the cigarette which contains a separating wall having a porosity of 42 amounts to 37 mm. This end length was therefore 2 mm shorter than the end length of the unmodified cigarettes, with which the standard value was determined. Notwithstanding that the variation of the end length of only 2 mm has a minimal influence upon the measured values of CO, it should be appreciated that the corresponding value of 91%, which corresponds to a CO reduction of 9% is actually to be corrected in such a manner that the CO reduction is somewhat greater than 9%.

Further of interest from this Table 2 is the fact that the measured values of CO increase above the level of the standard value of 73.5 with increasing porosity. With a porosity of 233, a CO value of 110 was measured, which corresponds to an increase of 50% with respect to the standard value. This value lies even higher than the value of the cigarette having a hollow inner channel, which does not contain any separating wall. It is of course to be noted that the end length of the cigarettes having separating walls with a porosity of 142 and 233 were only 34 mm and 29 mm, respectively. These end lengths were therefore 5 mm and 10 mm, respectively, shorter than the end lengths of the unmodified cigarette, with which the standard value was determined. Such variations of the end lengths, and thus, the corresponding variations of the amounts of burned tobacco obviously have considerable influence upon the total CO content measured, so that the CO values of 91 and 110, which correspond respectively to the cigarettes having separating walls with porosities of 142 and 233, must be corrected to a considerable degree toward the lower side. Only after such a correction, can an ultimate, direct comparison with the CO value of the standard cigarette be carried out.

Finally, it will be noted that, with increasing porosity of the separating wall, the cigarette modified in accordance with the invention becomes increasingly more divergent from the character of a normal cigarette. With the normal cigarette, in connection with which the tobacco is distributed approximately uniformly within the entire volume of the outer cigarette paper, all of the air which is drawn through the cigarette must of necessity pass through the burning zone. This takes place in the same manner as with cigarettes according to the invention which have a completely air-impermeable inner separating wall which abuts tightly with the tobacco. However, in connection with cigarettes modified according to the invention by having a porous inner separating wall, a portion of the air drawn through the cigarette will be drawn into the tobacco-free hollow space and pass through the pores *behind* the burning zone. The air penetrates into the length of tobacco in a radial direction, from inside toward outside, and is then passed into the filter. The more porous the separating wall, the greater is the proportion of the amount of air drawn through the cigarette in this manner, and the more the character of this cigarette differs from the character of the normal cigarette.

In addition to the influence of the porosity of the inner separating walls, there was also investigated the influence on the reduction of the CO content of the diameter of the tobacco-free space which is separated by the inner separating wall. For these investigations cigarettes were employed which contain a separating wall made of typing paper having a weight per unit surface area of 80 g/m$^2$. Just as in the case of the cigarettes employed to investigate the influence of porosity, these inner separating walls were once again glued along their overlapping folding borders. These separating walls were twisted together on the end next to the cigarette mouthpiece, so that they were also air-impermeable at their forward end. Also, in this case cigarettes were investigated which in one instance were obtained by modification of cigarettes of the brand "Auslese" and in another instance by modification of commercially available cigarettes of the brand "R 6".

There were investigated, respectively, cigarettes wherein the tobacco-free space, which was separated from the tobacco by the separating wall, had diameters of 1, 2, 3 and 4mm. The CO content was once again determined in dimensionless units of linear scale. The experimental results for cigarettes according to the invention which were obtained by formation of a separating wall of this type in cigarettes of the brand "Auslese" are set forth in Table 3.

TABLE 3

| Cigarettes of the brand "Auslese" Standard Value: $CO_{standard} = 91$ Diameter of the tobacco-free space in mm | 1 | 2 | 3 | 4 |
|---|---|---|---|---|
| CO content in dimensionless units | 90 | 80 | 66 | 50 |
| CO content in percent of the standard value | 99 | 88 | 70 | 55 |

In a completely analogous fashion, there were also investigated cigarettes modified in accordance with the invention which were prepared from commercially available cigarettes of the brand "R 6". The results for this brand are set forth in Table 4.

TABLE 4

| Cigarettes of the brand "R 6" Standard Value: $CO_{Standard} = 72$ Diameter of the tobacco-free space in mm | 1 | 2 | 3 | 4 |
|---|---|---|---|---|
| CO content in dimensionless units | 68 | 56 | 49 | 36 |
| CO content in percent of the standard value | 95 | 78 | 68 | 50 |

From these two Tables 3 and 4 it can be seen that there is no significant reduction of the CO content in the case of a tobacco-free space having a diameter of 1 mm. The reduction of 5% according to Table 4 is still possibly within the margin of experimental error and only so inconsequential that it is possible to consider this as no substantial reduction at all. This diameter of 1 mm can therefore be considered as the lower limiting value for the tobacco-free space provided in accordance with the invention (for a cigarette of 8 mm diameter).

In the case of tobacco-free spaces having a diameter of 2 mm., there is obtained already according to Table 3 a reduction of the CO content of 12%, and according to Table 4 a reduction of the CO content of 22%. As can be ascertained from these two tables, the reduction effect increases even further as the diameter increases above 3 mm. to 4 mm.

It should be appreciated that, with cigarettes modified in this fashion, diameters of the tobacco-free space of greater than 6 mm. are hardly capable of production, at least not with normal cigarettes. With this type of modification, it would obviously be necessary to displace the total amount of tobacco arranged inside of the outer shell of cigarette paper into the annular region. Thus, as the diameter of the tobacco-free space increases, the compaction of the tobacco also increases. The increasing values of compaction are set forth in Table 5.

TABLE 5

| Diameter | Tobacco Density Relation | Increase in Density |
|---|---|---|
| 0 | 1 | 0 |
| 1 | 1.015 | 1.5 |
| 2 | 1.066 | 6.6 |
| 3 | 1.163 | 16.3 |
| 4 | 1.333 | 33.3 |

These density relationships were calculated as follows: First, the density of the tobacco in a normal cigarette was determined in g/cm$^3$. Subsequently, there was calculated the volume of the annular space when tobacco-free spaces having diameters of 1, 2, 3 and 4 mm. were produced in the cigarette. The weight of the total amount of tobacco divided by the volume of this annular region gave the respective densities of the tobacco in the annular region. Then, the value of the density in the annular region was divided by the value of the density in the normal cigarette. In this way, the value of the weight disappears through cancellation. These density relationships, which obviously must always have a value greater than 1, are therefore valid for all of the cigarettes.

As can be seen from Table 5, a cigarette having a tobacco-free space with a diameter of 4 mm. already has a density which is 33% higher than a normal cigarette. If the diameter is enlarged, the increase in the density likewise increases, and it actually increases at a rate which is considerably more than a linear relationship. On this basis, it is hardly possible to produce in commercially available cigarettes, which have a diameter of 8 mm., tobacco-free spaces having a diameter of greater than 6 mm., without removing some of the originally present tobacco. If such a preparation procedure is attempted, the outer cigarette paper typically splits.

It was also attempted to first insert the conventional cigarette into a rigid shell, e.g., of metal, the diameter of which is slightly smaller than that of the cigarette. Even in the case of such a cigarette wherein the outer paper shell is supported by this metal housing, when a glass rod having a diameter of more than 6 mm. is introduced, whereby the total amount of tobacco is displaced into the remaining annular region, the cigarette paper regularly split inside of the housing.

From the measurements which were carried out and which are set forth in Tables 3 and 4, it can be concluded that the effect of the CO reduction is increased with increasing diameter of the tobacco-free region, without the result that the compaction of the tobacco in the annular space, at least in the density range measured, produces a disadvantageous result. For the sake of completeness, the resistance to drawing or puffing of cigarettes according to the invention was also measured as a function of the diameter of the tobacco-free space. This was accomplished by measuring the partial vacuum which resulted during the draws at the mouthpiece side of the filter. The respective partial vacuums resulting during the second draw, measured in mm-$H_2O$, are set forth in Table 6.

TABLE 6

Resistance to draw, represented by the resulting partial vacuum:

| Diameter of the tobacco-free space (mm) | Partial vacuum in mm-$H_2O$ |
|---|---|
| 0 | 90 |
| 1 | 92 |
| 2 | 100 |
| 3 | 110 |
| 4 | 125 |

It is possible that the effect achieved according to the invention is partially or even considerably due to the fact that the central region of the cigarette does not contain any tobacco. It is precisely in this central region where the amount of available air is particularly small, since none of the air entering the cigarette through the outer cigarette paper passes into this region. To the extent that the results according to the invention are due to this effect, the result comes into play independently of the density of the tobacco in the surrounding annular space. In this case, the result will also be achieved if there is removed from the cigarettes to be modified the amount of tobacco which is present in the case of the normal cigarette in a volume which is subsequently to be hollowed out within the cigarette. Cigarettes of this type have therefore always the same tobacco density in the annular space, independent of whether the tobacco-free space, which is separated from the tobacco by a separating, wall has a diameter of 1, 2, 3, 4 or even 5 or 6 mm. This consideration is important because cigarettes modified in accordance with the invention having a diameter of the tobacco-free space of 5 or even 6 mm. and having a tobacco density in the annular space which is the same as that of the normal cigarette are very difficult to produce. Obviously, the cigarettes also fall within the scope of the invention. There are obviously upper limits for the diameter of the tobacco-free space in such cigarettes. If, for example, the tobacco-free space has a diameter of 7.5 mm. in a normal cigarette having an outer diameter of 8 mm., the cross section of the annular space has a surface area of merely about 6 mm.$^2$, as opposed to a cross section of 50 mm.$^2$ for a normal cigarette. Since the tobacco filling in this annular space is to have the density of a normal cigarette, this cigarette would contain only 12% of the usual amount of tobacco. Whereas a conventional cigarette permits about 9 to 10 draws (CORESTA NORM) this cigarette would permit only about 1 draw having the same amount of smoke. The upper limit for the diameter of the tobacco-free space in the case of cigarettes in which the density of the tobacco in the annular space is the same as that of a normal cigarette should therefore be less than 7.5 mm.

All of the measurements were carried out in a manner corresponding to the CORESTA NORM in which the cigarette is drawn upon for 2 seconds during each minute of elapsed time and in which a volume of 35 ml. is thereby drawn in. Obviously, as has been demonstrated by subsequent measurements, the effect according to the invention is also obtained when a smaller volume of, for example, 30 ml., or a larger volume of, for example, 40 ml. is drawn from the cigarette within the same drawing period.

It is furthermore to be noted that in addition to the direct reduction of carbon monoxide in the total amount of combustion gases drawn from the cigarette, there occurs still a further effect, namely, that of decreasing toxicity. All cigarettes exhibit in known fashion an increasing gradient of the proportion of harmful substances as the number of draws is increased. Also in the case of a cigarette modified in accordance with the invention is there likewise an increasing gradient; however, the rate of increase for the gradient from draw to draw is substantially smaller than in the case of a normal cigarette. As the diameter of the tobacco-free inner space becomes larger the increase of the gradient from draw to draw becomes smaller.

Therefore, the common effect occurring during smoking of normal cigarettes, namely, that the last one to three draws on the cigarette are considerably more toxic than the first draw, is considerably diminished in accordance with the present invention.

In summary, it can be said that cigarettes having as much as about 88% of their cross-sectional area occupied by the tobaccoless region are contemplated in accordance with the invention, although such cigarettes are impractical and very difficult to produce. More preferred are cigarettes where the cross-sectional area of the tobaccoless region is less than about 60% of the total cigarette cross-section. Even more preferred are cigarettes wherein the tobaccoless region comprises between about 1.5 and 50%, and most preferably between about 6 and 25%, of the total cross-sectional area of the cigarette. The tobaccoless region preferably extends along a major portion of the longitudinal dimension of the cigarette, and may extend along the entire length thereof.

The invention also serves to reduce the contents of tars in the products of combustion. This result can be read from the fact that filters of smoked cigarettes, which were modified according to the invention, are less coloured than filters of smoked normal cigarettes, as can be seen with the naked eye.

What is claimed is:

1. A tobacco-filled smoking article having a mouthpiece end and an end to be lighted and being adapted to produce a low proportion of carbon monoxide in the gaseous products of combustion, comprising a tobacco filling and means for radially confining said tobacco, wherein within the volume of tobacco and spaced from said tobacco-confining means, there is at least one tobaccoless region separated from the tobacco by a substantially air-impermeable partition which is combustible and which remains form-stable under the effect of heat during burning of the tobacco in a combustion zone in order to prevent external air from passing through the partition into the inner region of the tobacco in the combustion zone and behind the combustion zone, said tobaccoless region being also substantially air-impermeable at its end adjacent the mouthpiece end of said smoking article, and the cross sectional area of said tobaccoless region being less than about 60% of the total cross-sectional area of said article.

2. The article in accordance with claim 1, wherein said region(s) is filled with a solid material.

3. The article in accordance with claim 1, wherein the partition comprises of a cellulose-containing material.

4. The article in accordance with claim 3, wherein said region(s) is hollow.

5. The article in accordance with claim 3, wherein the cellulose-containing material is paper.

6. The article in accordance with claim 3, wherein said paper has a porosity for air of less than about 94 ml/min. $\times$ cm$^2$ $\times$ 100 mm $H_2O$.

7. The article in accordance with claim 1, wherein the partition contains an oxidizing agent.

8. The article in accordance with claim 7, wherein the partition is impregnated with at least one oxidizing agent.

9. The article in accordance with claim 1, wherein said tobaccoless region(s) is a rigid body comprised of a combustible material which does not burn or smoulder more rapidly than the tobacco.

10. The article in accordance with claim 9, wherein the body is hollow.

11. The article in accordance with claim 10, wherein the body is filled.

12. The article in accordance with claim 9, wherein the body is filled with a solid material.

13. The article in accordance with claim 12, wherein the body consists of rolled material.

14. The article in accordance with claim 12, wherein the body consists of rolled cellulose-containing material.

15. The article in accordance with claim 9 wherein the body comprises at least one additive which promotes combustion.

16. The article in accordance with claim 9, wherein said rigid body is less air-permeable than a barrier having a porosity for air of 94 ml/min $\times$ cm$^2$ $\times$ 100 mm. $H_2O$.

17. The article in accordance with claim 1, wherein the partition between the tobaccoless region(s) and the tobacco consists of a material which on combustion assumes an amorphous consistency similar to tobacco ash.

18. The article in accordance with claim 1, wherein said tobaccoless region(s) is cylindrical and is aligned in the longitudinal direction of the article.

19. The article in accordance with claim 1, wherein said tobaccoless region(s) has a non-linearly changing diameter.

20. The article in accordance with claim 1, wherein said article is a cigarette.

21. The article in accordance with claim 1, wherein at least one of said tobaccoless region(s) has a portion which is not surrounded by tobacco and wherein said portion is covered by a substantially air-impermeable barrier.

22. The article in accordance with claim 1, wherein said partition has a porosity for air of less than about 94 ml/min $\times$ cm$^2$ $\times$ 100 mm $H_2O$.

23. The article in accordance with claim 1, wherein said article has a diameter of about 8 mm. and said tobaccoless region has a diameter less than about 6 mm.

24. The article in accordance with claim 1, wherein the cross-sectional area of said tobaccoless region is greater that about 6% and less than about 25% of the total cross-sectional area of said article.

25. The article in accordance with claim 1, wherein the cross-sectional area of said tobaccoless region is greater than about 1.5% and less than about 50% of the total cross-sectional area of said article.

26. A tobacco-filled smoking article having a mouthpiece end and an end to be lighted and being adapted to produce a low proportion of carbon monoxide in the gaseous products of combustion, comprising a tobacco filling and means for radially confining said tobacco, wherein within the volume of tobacco and spaced from said radial tobacco-confining means, there is at least one tobaccoless region separated from the tobacco by a substantially air-impermeable partition which remains form-stable under the effect of heat during burning of the tobacco in a combustion zone in order to prevent external air from passing through the partition into the inner region of the tobacco in the combustion zone and behind the combustion zone, said tobaccoless region being also substantially air-impermeable at its end adjacent the mouthpiece end of said smoking article, said tobaccoless region being filled with cellulose-containing material and the cross sectional area of said tobaccoless region being less than about 60% of the total cross-sectional area of said article.

27. The article in accordance with claim 26, wherein said region is filled with rolled paper.

* * * * *